United States Patent [19]

Byrd

[11] Patent Number: 4,738,579

[45] Date of Patent: Apr. 19, 1988

[54] AUTOMATED PARKING GARAGE SYSTEM

[76] Inventor: Russell A. Byrd, 2601 17th St., Bakersfield, Calif. 93301

[21] Appl. No.: 863,438

[22] Filed: May 15, 1986

[51] Int. Cl.[4] ..... E04H 6/40

[52] U.S. Cl. ..... 414/233; 187/95; 414/231

[58] Field of Search ..... 414/231, 232, 234, 239, 414/240, 242, 244, 246; 52/125.1, 174; 187/95

[56] References Cited

U.S. PATENT DOCUMENTS

| | | | |
|---|---|---|---|
| 670,466 | 3/1901 | Bolander | 187/95 |
| 1,906,773 | 5/1933 | Scott | 414/233 X |
| 2,228,227 | 1/1941 | Eames | 187/95 |
| 2,309,123 | 1/1943 | Kiesling | 187/95 |
| 2,787,386 | 4/1957 | Peterson | 414/233 X |
| 2,911,115 | 11/1959 | Jacobsen | 414/242 |
| 2,930,497 | 3/1960 | Wheeler | 414/240 |
| 3,085,700 | 4/1963 | O'Sullivan | 414/234 |
| 3,802,579 | 4/1974 | Genest et al. . | |
| 4,322,804 | 3/1982 | Evans | 414/231 X |
| 4,352,621 | 10/1982 | Künner | 414/231 |

FOREIGN PATENT DOCUMENTS

| | | | |
|---|---|---|---|
| 1280542 | 10/1968 | Fed. Rep. of Germany . | |
| 93023 | 12/1959 | Netherlands | 414/242 |

*Primary Examiner*—Peter A. Aschenbrenner
*Attorney, Agent, or Firm*—Staas & Halsey

[57] ABSTRACT

An automated parking garage system having a plurality of modules arranged in, for example, a grid pattern, each module having a plurality of stacked storage positions. An empty storage position for each module or the top of the module is positioned at an access point so that vehicles can easily and quickly access or exit the system. Each of the modules includes a roller system so that modules can slidably move up and down in response to movement of a hydraulic power system controlled in accordance with signals to move an empty storage position of the module or top of a module to an access point. The hydraulic system also moves the modules in response to a request to retrieve a vehicle.

5 Claims, 10 Drawing Sheets

AUTOMATED PARKING GARAGE SYSTEM

BACKGROUND OF THE INVENTION

In metropolitan areas throughout the the world there is tremendous need for space to park automobiles in order to help alleviate traffic congestion in large metropolitan areas. Previously, parking systems have been proposed which require that individual automobiles be lifted by an elevator and stored in a "pigeon hole" manner. Such systems do not meet the primary needs of a parking system which include easy and quick access to a car. Furthermore, such systems required an operator to be present and individually access vehicles for various customers. Such systems result in slow operation and lines of cars waiting to exit from and enter into a parking complex. Moreover, prior semi-automated parking systems as well as non-automated systems frequently require an operator to actually park and retrieve vehicles. Such systems create serious security problems, as well as fail to provide the speed of access required for parking complexes in large metropolitan areas.

SUMMARY OF THE INVENTION

An object of the present invention is to provide a parking system enabling quick access for vehicles.

Another object of the present invention is to provide a highly compact parking system occupying a minimum amount of land.

Another object of the present invention is to provide a parking system enabling immediate parking of a vehicle by a driver of the vehicle.

Still a further object of the present invention is to provide a parking system enabling simultaneous entrance and/or exit by several vehicles.

Still a further object of the present invention is to provide a parking system enabling fast self parking of vehicles.

To achieve the above and other objects of the present invention, the parking system of the present invention comprises a housing having a ground level access point and having shafts positioned therein; storage means positioned with the shafts, for providing a plurality of storage positions, each having an empty or filled status; roller means, positioned between the housing and the storage means, for enabling the storage means to slidably move within the shafts; power means for moving the storage means within the shafts in response to a control signal; and control means for providing the control signal in accordance with the desired movement of the storage means.

In a preferred embodiment of the present invention, the housing is constructed with a desired number of shafts, and modules having stacked storage positions corresponding to the storage means are positioned within each of the shafts. The power means can be embodied in a hydraulic system which moves each of the modules within the shafts. The roller means comprises a set of rollers positioned between the modules and the housing so as to permit the modules to slidably move within the shafts while maintaining each of the modules in a relatively fixed position with respect to the sides of the shafts. The control means can comprise solid state controls, standard relay logic or a microprocessor driven system. The control means maintains an empty storage position of a module or the top of a module at the ground level access point; thus, providing quick and easy access to the parking system.

BRIEF DESCRIPTION OF THE DRAWINGS

The accompanying drawings, which incorporated and constitute part of the specification, illustrate an embodiment of the present invention, and together with the description serve to explain the principles of the invention.

DETAILED DESCRIPTION OF THE PREFERRED EMBODIMENTS

Figure 1:
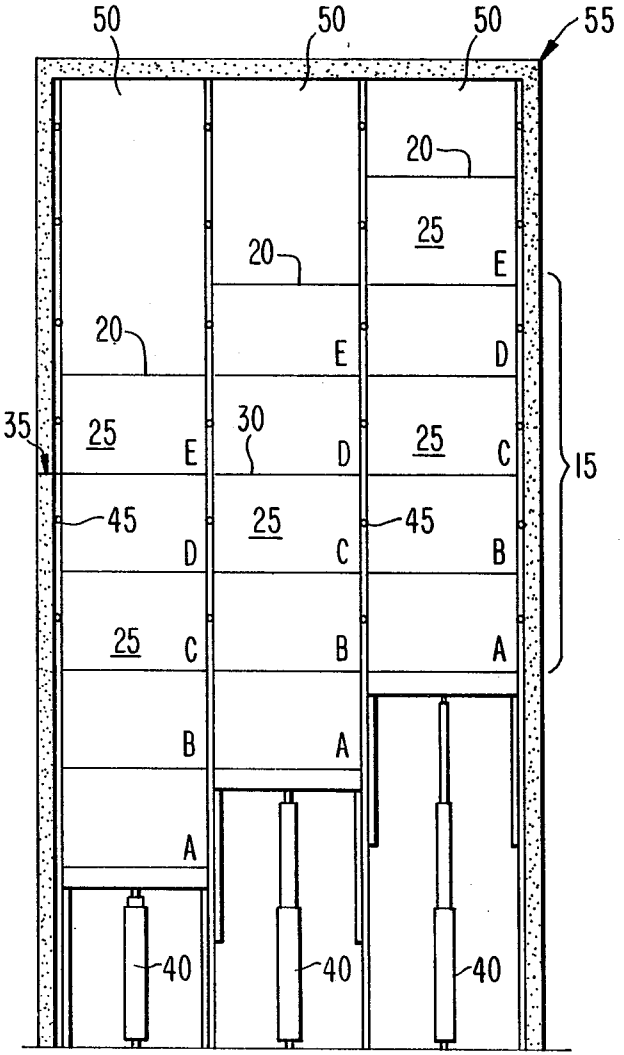
FIG. 1 is a front view of an embodiment of the present invention.

FIG. 1 is a front view of an embodiment of the present invention. In FIG. 1 there are three modules 15 each having a top 20 and five storage positions 25. To store a vehicle in or retrieve a vehicle from a storage position 25, the bottom of a storage position 30 must be at the ground level access point 35.

Figure 2:
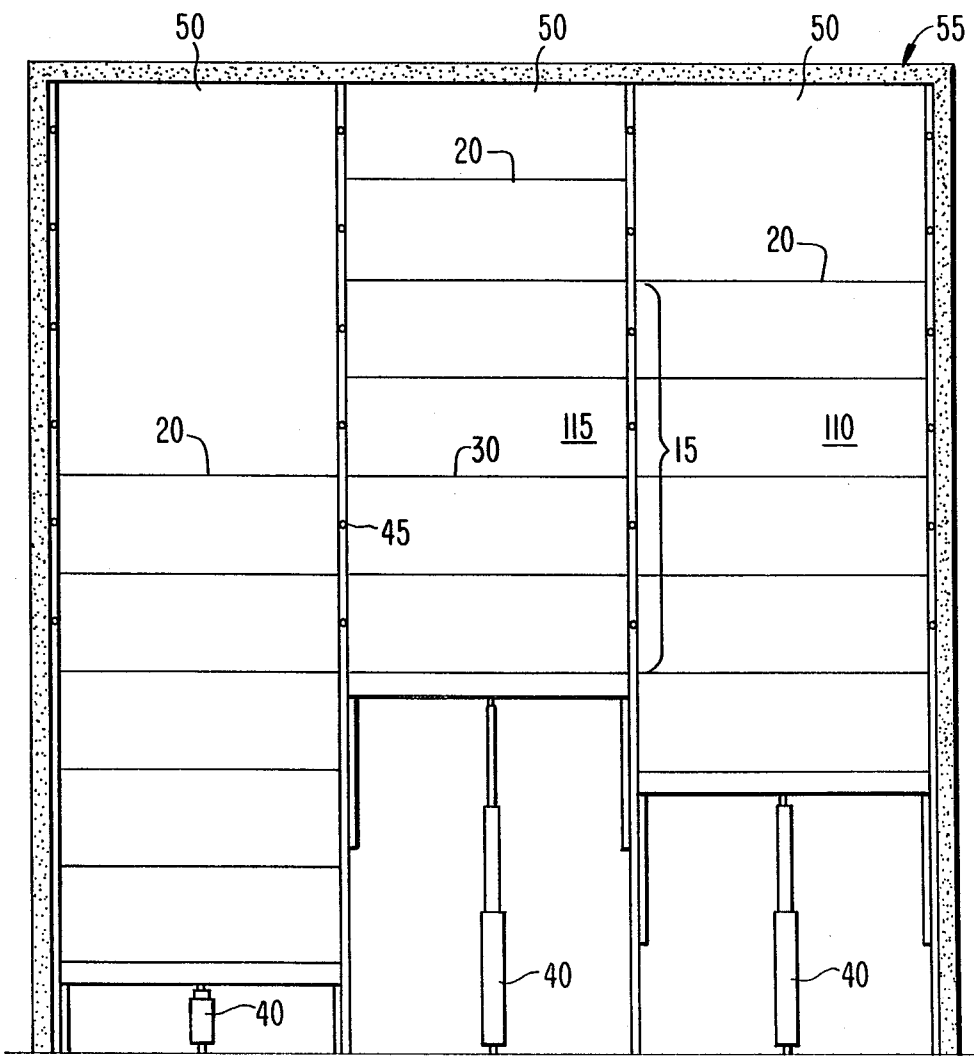
FIG. 2 is a side view of the FIG. 1 embodiment.

Moreover, to store a vehicle there must be an empty storage position in a lane which comprises, for example, storage postions 110 and 115 and module top 20 as shown in FIG. 2. If there are no empty storage positions, then a gate (not shown) blocks entrance to the lane. The gate opens to allow a car to leave or to allow a car to enter. After a car enters, the gate remains open, and as a result, insures that no module in that lane moves. After the driver parks the vehicle and leaves the lane, the gate closes and enables movement of modules within the lane. Those skilled in the art will readily recognize that closing of the gate after a driver exits the lane can be accomplished by any of several means. For example, the driver could trip a photocell or series of photocells, or the driver could insert a card (received upon entry) into a common magnetic reader after exiting the lane which would cause the gate to close.

The modules 15 are raised and lowered via hydraulic pistons 40. The hydraulic system driving the hydraulic pistons 40 is described below. Roller system 45 schematically represented in FIG. 1 enable each of the modules 15 to slidably move within the shafts 50. A housing 55 can be structured so that the modules 15, when raised to their highest position, are enclosed within the housing 55; or the top of the housing can comprise a grid allowing the modules to penetrate the housing 55, and extend above the housing 55.

Figure 3:
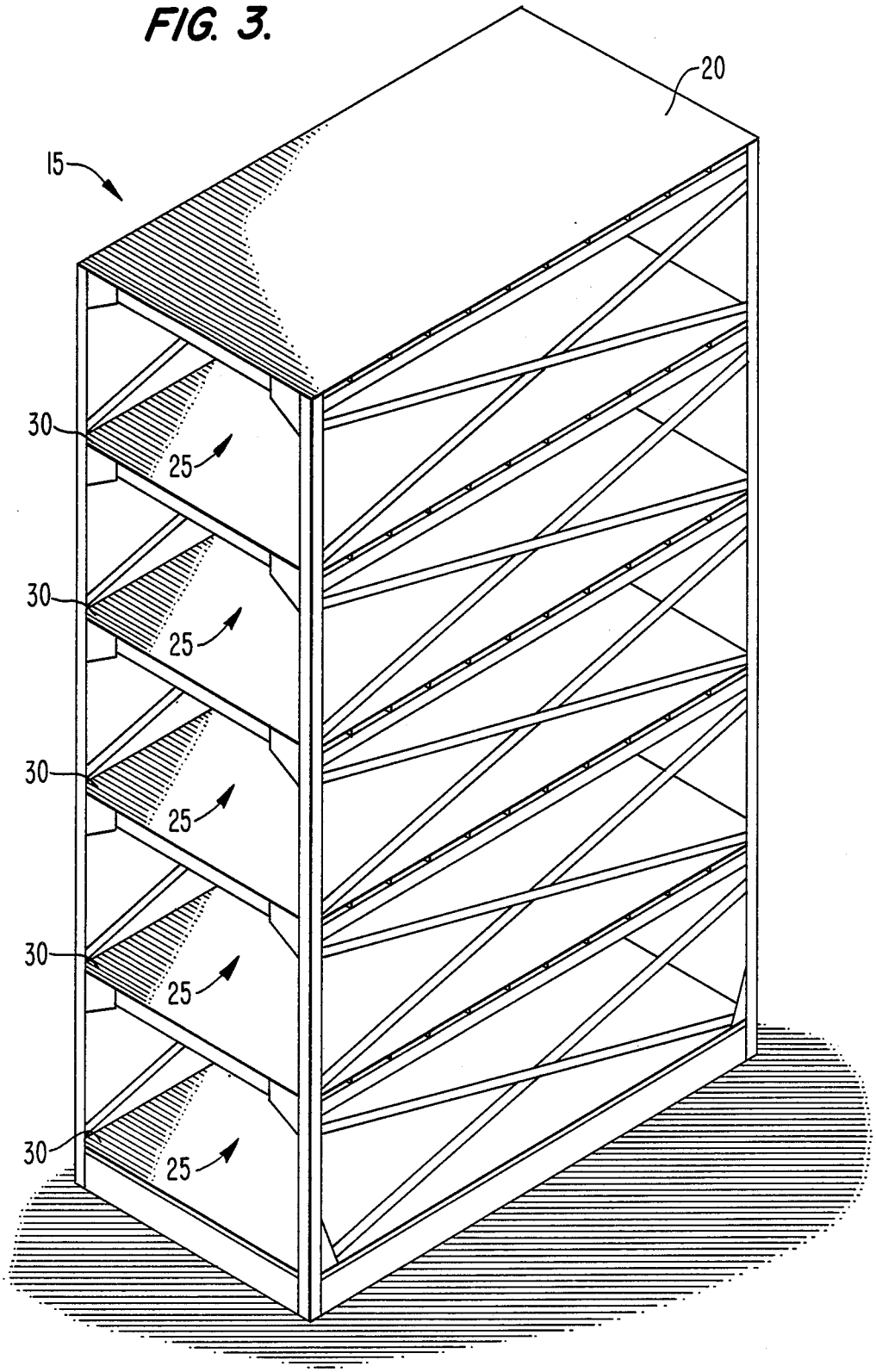
FIG. 3 is a perspective view of a module of the FIG. 1 embodiment.
Figure 5:
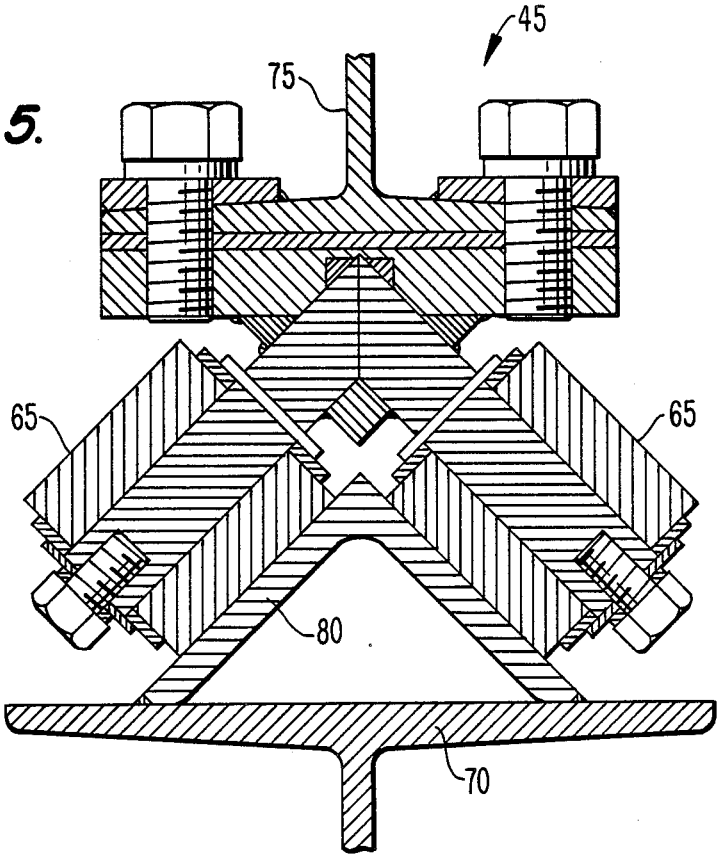
FIG. 5 illustrates a second embodiment of a roller system of the present invention.

The roller system 45 can, as illustrated in FIGS. 1 and 2, be mounted on the structural members of the housing 55, or can be mounted on the modules 15 (e.g., as shown in FIG. 5). FIG. 2 illustrates a side view of the system shown in FIG. 1 with like reference numerals identifying like elements. FIG. 3 is a perspective view of one of the modules 15 shown in FIGS. 1 and 2.

Figure 4:
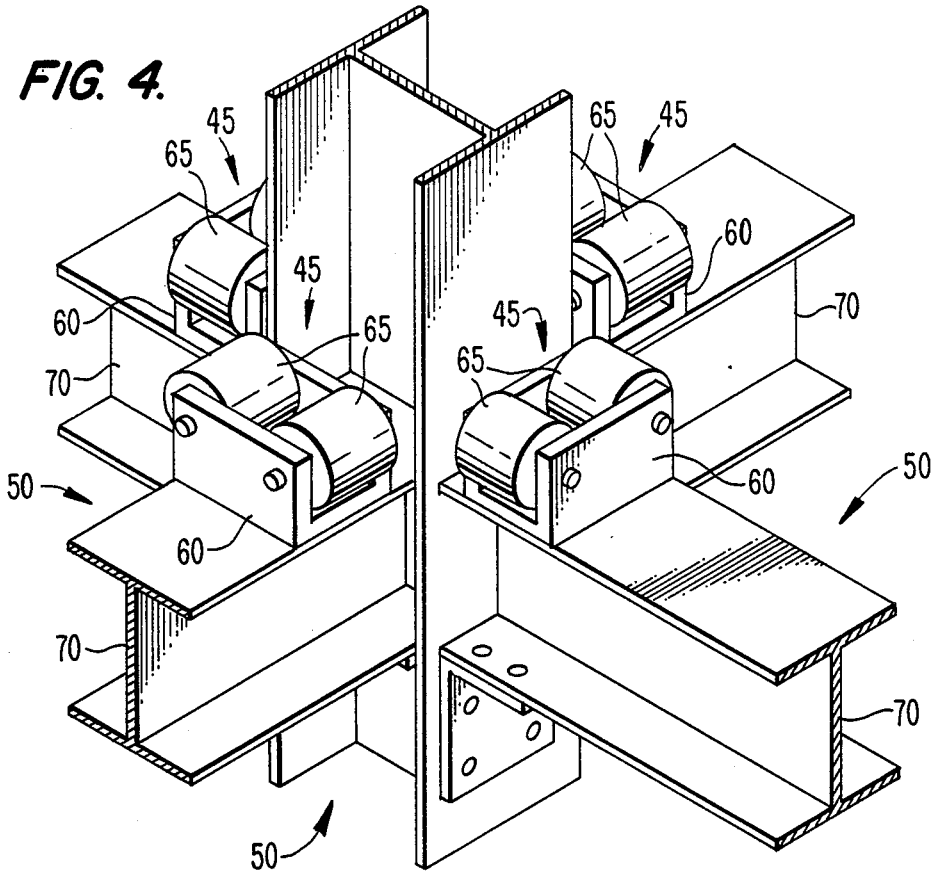
FIG. 4 is a perspective view of one embodiment of a roller system of the present inventions.

FIG. 4 illustrates a first embodiment of the roller system 45 of the present invention. The roller system 45 comprises a support assembly 60 with rollers 65 mounted thereon. Each of the rollers 65 is positioned within the support assembly 60 so that the rollers 65 extend between a module 15 (not shown in FIG. 4) and a structural member 70 of the housing 55. The rollers 65, therefore, tend to hold the modules 15 in a substantially constant position with respect to the structural member 70 of the housing 55.

FIG. 5 illustrates a second embodiment of the roller system 45. In FIG. 5 the roller system 45 is mounted on a structural member 75 of the module 15. The rollers 65 rotatably contact a rail 80 mounted on a structural member 70 of the housing 55. A roller system 45 such as illustrated in FIG. 5 can be mounted on each side of the module 15, or for example, can be mounted on opposing sides of the module 15. As a result the module 15 is held in a substantially constant relationship with respect to the structural member 70 of the housing 55.

Figure 6:
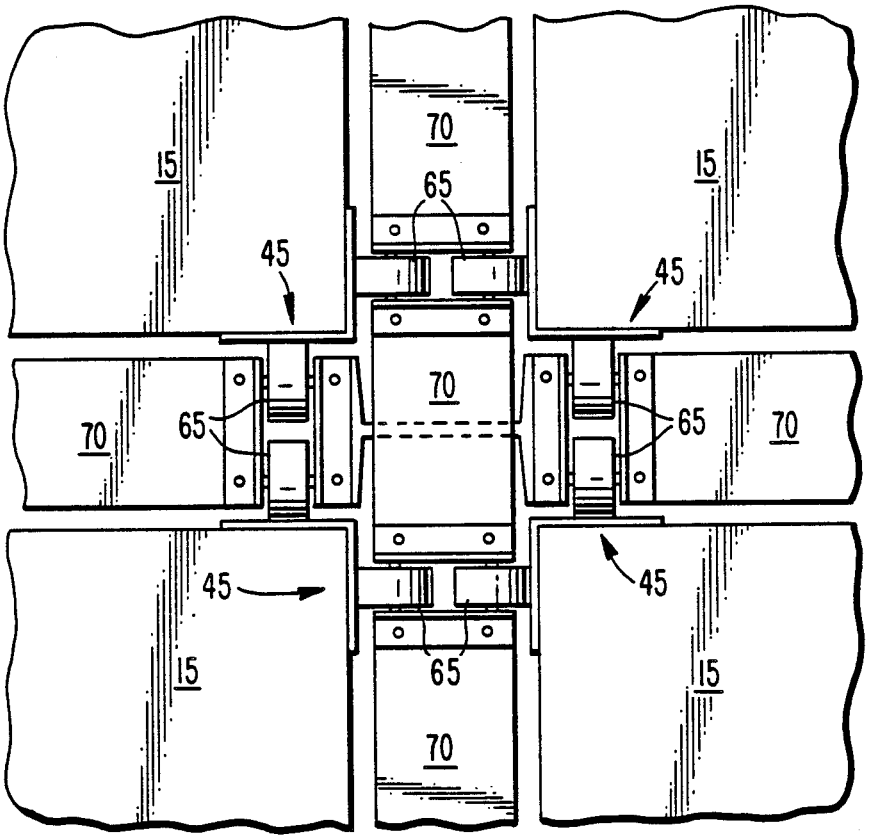
FIG. 6 is a top view of a third embodiment of a roller system of the present invention.

FIG. 6 illustrates a third embodiment of the roller system 45 of the present invention. FIG. 6 illustrates the roller 65 mounted on the modules 15 and rotatably engaging the structural members 70 of the housing 55. Alternatively, the rollers 65 can be mounted on the structural member 70 of the housing 55.

Figure 7:
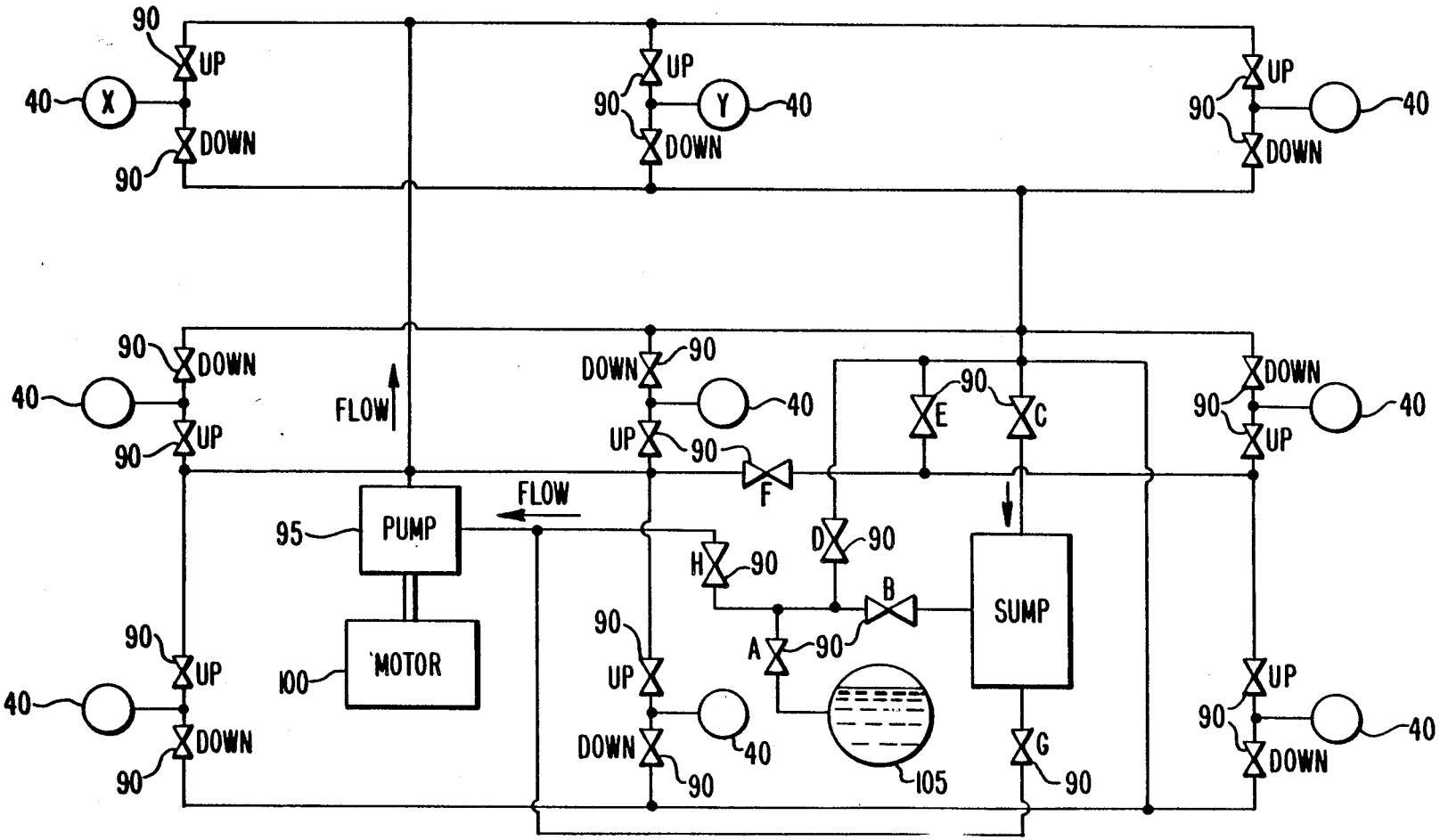
FIG. 7 is a schematic illustration of an embodiment of the hydraulic system of the present invention.

FIG. 7 schematically illustrates an embodiment of the hydraulic control system of the present invention, in FIG. 7, solenoid valves 90 labelled UP, are open when the associated hydraulic piston 40 is being raised. The solenoid valves 90 labelled DOWN, are open when the associated hydraulic piston 40 is being lowered. When a hydraulic piston 40 such as X, is being raised and all other hydraulic pistons 40 are stable, a pump 95 driven by a motor 100 pumps hydraulic fluid from the SUMP through solenoid valve 90 associated with the hydraulic piston X in order to raise hydraulic piston X. All of the remaining valves are closed.

If a sensor (not shown) detects that the pressure for the hydraulic piston X is less than the pressure in the accumulator 105, then valves A, D, E and F are opened allowing the accumulator 105 to supply hydraulic fluid to the up lines. In the case discussed above, the hydraulic fluid would be supplied from the accumulator 105 through valves A and H to pump 95; thus reducing the load on the motor 100. If, during the course of raising hydraulic piston X, a sensor (not shown) detects that the pressure in the accumulator 105 drops below a predetermined value, then valves E and F are closed, and valves A and H remain open so that the hydraulic pressure in the accumulator 105 assists the operation of pump 95.

If either the pressure in the accumulator 105 drops below a predetermined value (e.g., the point at which the pressure is insufficient to assist the pump 95) or the level of the hydraulic fluid in the accumulator 105 drops below a predetermined level, then valve A is closed and valve B is opened so that the pump 95 draws hydraulic fluid from the SUMP. When the hydraulic piston X reaches its desired position, all of the valves are closed and the motor 100 is turned off so that the pump 95 stops pumping the hydraulic fluid.

During operation of the hydraulic system, if the hydraulic piston X is selected to be raised or is being raised, and piston Y is being lowered or is selected to be lowered, then the hydraulic system of the present invention enables the hydraulic pressure generated by the hydraulic piston Y being lowered to assist in the raising of hydraulic piston X. For example, in such a case the hydraulic fluid passing out of the hydraulic piston Y through the down valve 90 passes through open valves E, D and H to assist the motion of the pump 95. If during this operation, the hydraulic piston Y stops its motion, then the down valve 90 as well as the valves D and E are closed, and valve B is opened to permit the pump 95 to draw hydraulic fluid from the SUMP. However, if a sensor (not shown) detects that the hydraulic pressure within the accumulator 105 is high enough to assist the pump 95, then valve A is opened and valve B is closed causing the pump 95 to draw hydraulic fluid from the pressurized accumulator 105. If during the above operation hydraulic piston X reaches its desired position before hydraulic piston Y, then the up valve 90 associated with hydraulic piston X is closed and the motor 100 stops motion of the pump 95. In addition, all of the valves are closed except the down valve 90 associated with the hydraulic piston Y and the valve C which is opened to permit the hydraulic fluid to pass from the hydraulic piston 40 into the SUMP.

Alternatively, if the pressure in the accumulator 105 is below a predetermined value, then the hydraulic fluid from the hydraulic piston Y can be used to increase the pressure within the accumulator 105. To accomplish this, the hydraulic fluid from the hydraulic piston Y passes through opened valves E, D and A; while valves H, B and C are closed. If during the course of increasing the pressure in the accumulator 105, the pressure reaches a predetermined maximum value, then valves A, D and E are closed and valve C is opened to permit the hydraulic fluid to flow into the SUMP. Those skilled in the art will readily recognize that the above operation can be applied to any combination of hydraulic pistons being raised or being lowered.

An advantage of a system such as disclosed in FIG. 7 is that it permits the accumulator 105, using the hydraulic pressure typically generated by a hydraulic piston being lowered, to supply all of the hydraulic pressure needed to raise a particular piston, or to assist the pump 95 in raising a particular hydraulic piston. In addition, when some hydraulic pistons are being raised and others lowered, the FIG. 7 system utilizes the pressure of the hydraulic fluid flowing from the hydraulic pistons being lowered to assist in the raising of the desired hydraulic pistons by opening valves D, E and H.

The hydraulic system shown in FIG. 7 enables the hydraulic pressure within the accumulator 105 to be increased to a desired level even when none of the hydraulic pistons 40 are in motion. To accomplish this, valves A, E, F and G would be opened to permit the pump 95 to draw hydraulic fluid from the SUMP and pump this fluid through valves F, E, D and A into the accumulator 105. All of the remaining valves are closed during this operation.

Figure 8B:
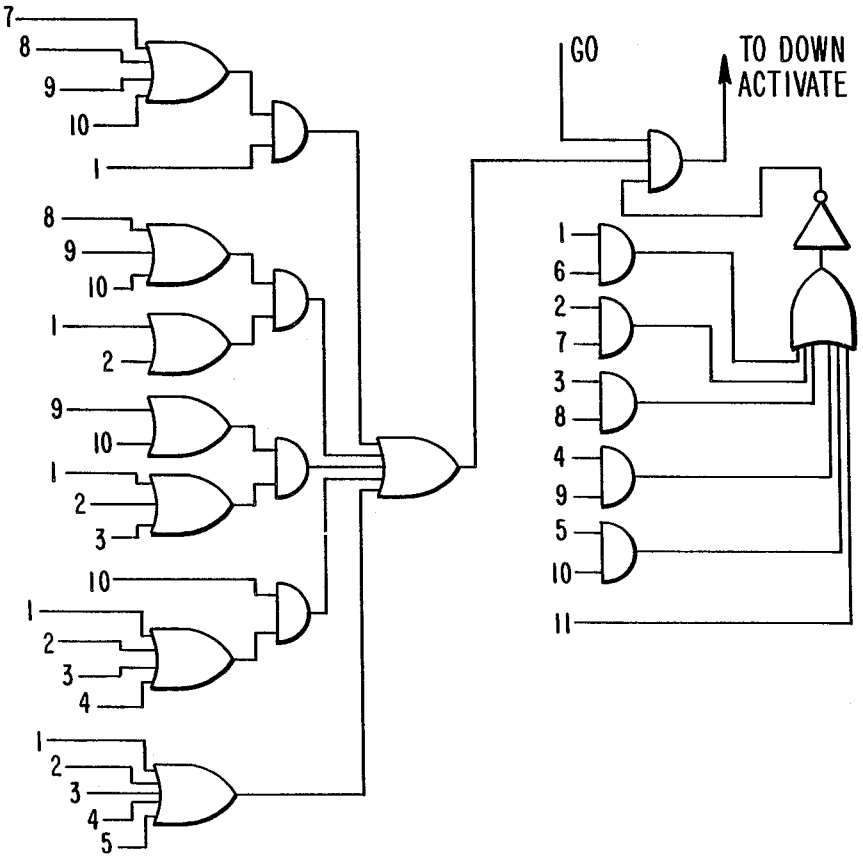
FIGS. 8A and 8B are schematic illustrations of up-down control logic of the present invention.
Figure 8A:
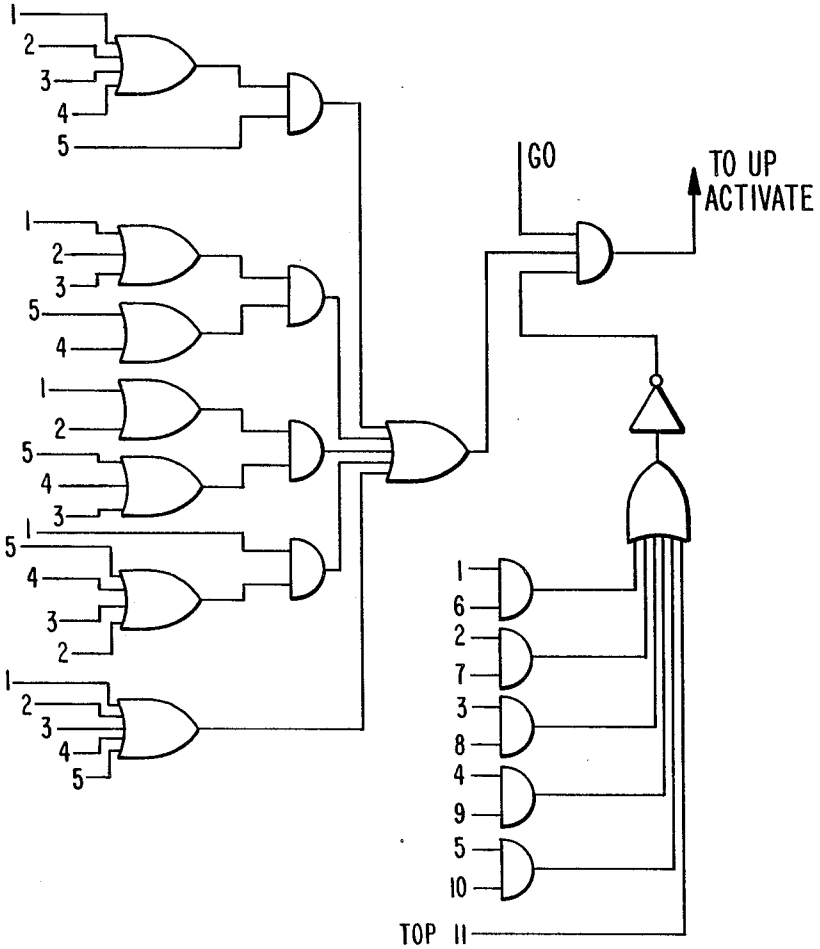

FIGS. 8A and 8B schematically illustrate up-down control logic of the present invention. As will be recognized by those skilled in the art the illustrated logic can be implemented by employing discrete logic devices, relay logic or software. The logic illustrated in FIGS. 8A and 8B automatically positions the bottom 30 of an empty storage position nearest the ground level access point 35 in a given module 15 or the top of the module at the ground level access point 35. As a result, either an empty storage position or the top of a module 15 is positioned at the ground level access point 35. This enables arriving vehicles to quickly enter the parking garage. Furthermore, because modules are automatically positioned with either an empty storage position 25 or the top of a module 15 at the ground level access point 35, vehicles can always travel through the parking garage system to empty storage positions in modules at the rear of the system such as the storage position 110 shown in FIG. 2. Additionally, the automatic positioning enables a vehicle parked in the storage position 110 to exit the parking system through the empty storage position 115 across the top of the front module and out of the parking system.

Figure 12:
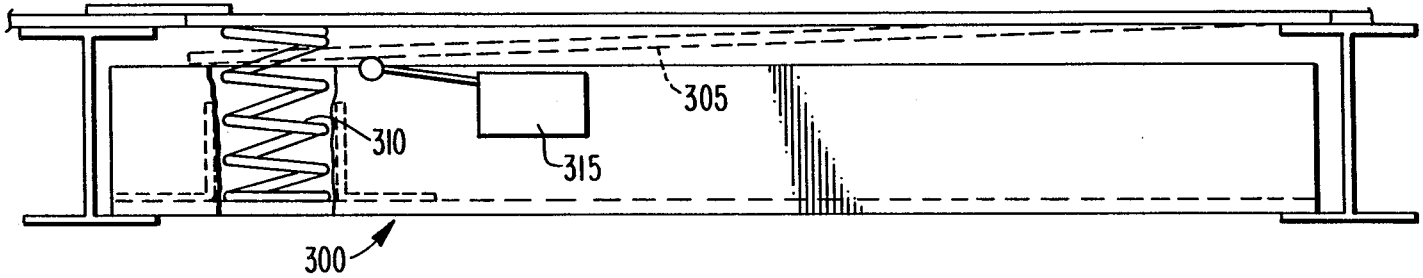
FIG. 12 is a side view of a sensor switch of the present invention.

A sensor system 300 (FIG. 12) detects the empty or filled status of any storage position 25. When a vehicle enters a module the weight of the vehicle depresses a plate 305 which is biased upwardly by a spring 310. Depression of plate 305 operates a sensor mechanism 315 which can be, for example, a micro switch, magnetic type switch, a photocell or any other sensor mechanism capable of detecting deflection of plate 305. As those skilled in the art will readily recognize, the empty/filled status of a storage position can be detected by any one of a variety of sensors, and is not limited to a system such as shown in FIG. 12. Other systems can include spring arms which are deflected by the side or other portion of an entering vehicle, photocells, and proximity detectors. In FIGS. 8A and 8B, the numerials at the input of the various gates represent the following states (with reference to FIGS. 1, 8A and 8B).

1 corresponds to storage position A being at the ground level access point
2 corresponds to storage position B being at the ground level access point
4 corresponds to storage position D being at the ground level access point
5 corresponds to storage position E being at the ground level access point
6 corresponds to storage position A being empty
7 corresponds to storage position B being empty
8 corresponds to storage position C being empty
9 corresponds to storage position D being empty
10 corresponds to storage position E being empty
11 corresponds to the top of a module being at the ground level access point Therefore, a given module 15 will automatically be lowered if the following logic expression is statisfied $$1\cdot(7+8+9+10)+(1+2)\cdot(8+9+10)+(1+2+3)\cdot(9+10)+(1+2+3+4)\cdot 10+(1+2+3+4+5) \quad 1$$

Referring to FIG. 8B, a module will stop with an empty stall at the ground level access point 35 when the following logic expression is not true.

$$1\cdot 6+2\cdot 7+3\cdot 8+4\cdot 9+5\cdot 10+11 \quad 2$$

A module will automatically be raised if the following logic expression is statisfied $$5\cdot(1+2+3+4)+4\cdot(1+2+3)+3\cdot(1+2)+2\cdot 1+(1+2+3+4+5) \quad 3$$

As a module is being raised, it will stop in accordance with the logic expression 2 as discussed above. The logic illustrated in FIGS. 8A and 8B represents the logic necessary to control a single module 15. Accordingly, the discrete logic circuit or relay circuit embodying the illustrated logic should be embodied for each module 15 in the parking system. Accordingly, software implementation of the illustrated logic may tend to reduce overall cost of a particular system. The UP ACTIVATE and DOWN ACTIVATE signals illustrated in FIGS. 8A and 8B, respectively, control the up and down solenoid valves for the particular module as illustrated in FIG. 7. The GO signal illustrated in FIGS. 8A and 8B corresponds to a signal indicating that the gate for each of the storage positions 25 (FIGS. 1 and 2) is in the closed position; thus, indicating that it is safe for the module to begin motion.

Figure 9:
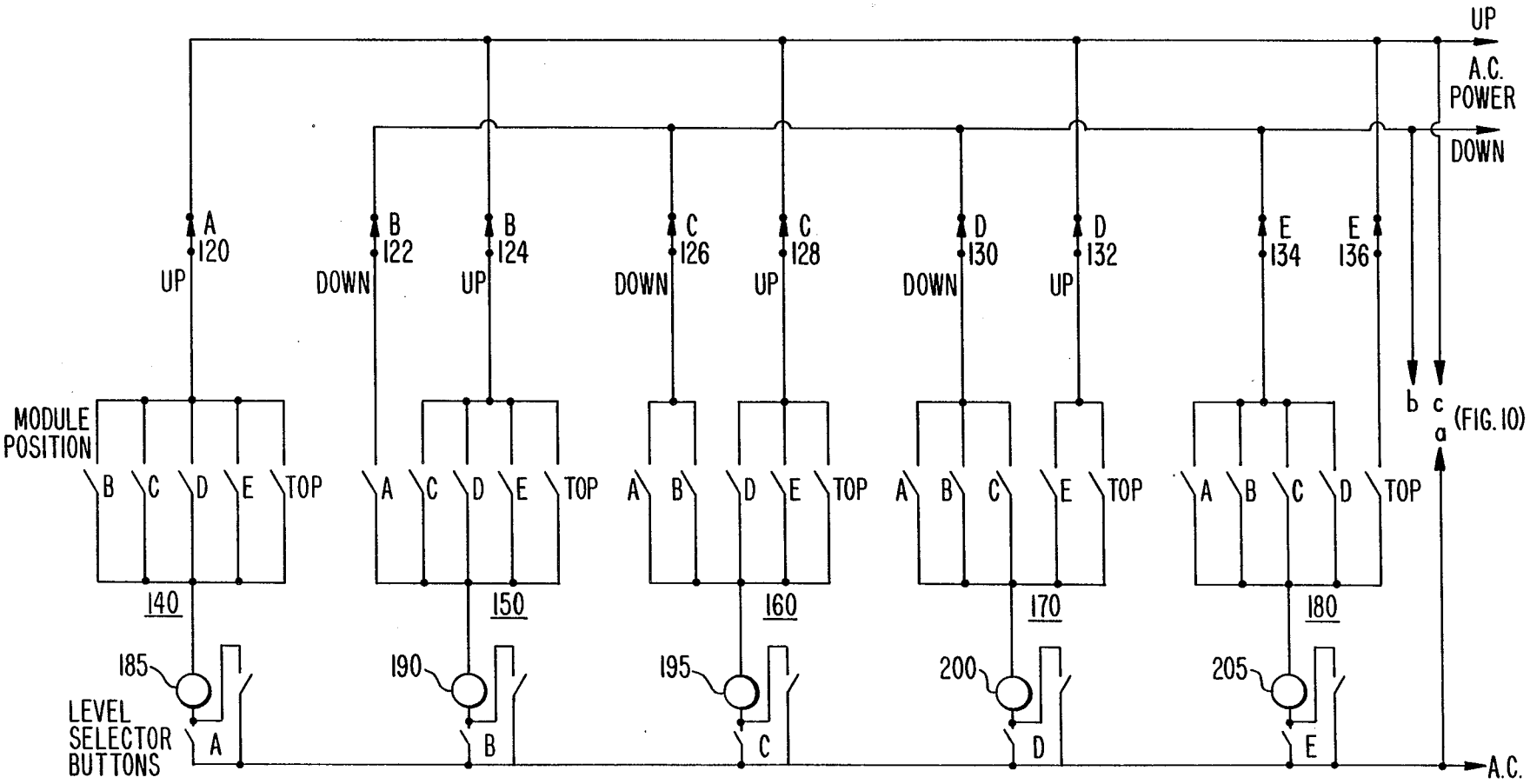
FIG. 9 is a schematic diagram of a manual positioning circuit of the present invention.

FIG. 9 illustrates a relay logic implementation of the logic for manually positioning a module at a given level. In FIG. 9 the module locating contacts 120 thru 136 are opened when the indicated level (e.g., A, B, C . . . ) is at the ground level access point 35. The module position contacts in the contact groups 140 through 180 are closed when the indicated level is at the ground level access point 35. In FIG. 9, the module locating contacts and the module position contacts are labeled with letters representing the associated storage position in a module 15 such as shown in FIG. 1. The level selector buttons 185 through 205 can comprise, for example, latching relays or flip-flops.

One example of the operation of the manual positioning circuit is described below. If it is desired to position the level A (FIG. 1) of a module 15 at the ground access point 35, then level selector switch 185 would be depressed. As illustrated in FIG. 1, initially the level E is at the ground level access point 35. Accordingly, the contact E in the module position contact group 140 would be closed. Since the level A is not at the ground level access point, then the module locate contact 120 is closed. Accordingly, a circuit is completed through switch 185, contact E of switch group 140 and module locating contact 120 to supply a.c. power to the UP solenoid for the module. The module is thus raised as discussed with reference to FIG. 7. As the module moves up, the module position contacts D, C, and B close in sequence. When the module is positioned so that the level A is at the level access point 35, the contact C of the module positioning contacts 140 opens and the module locating contact 120 also opens; thus, stopping motion of the module by removing a.c. power from the UP solenoid. Those skilled in the art will readily recognize that the relay logic illustrated in FIG. 9 can be easily implemented in software in accordance with the logic illustrated in FIG. 9.

Figure 10:
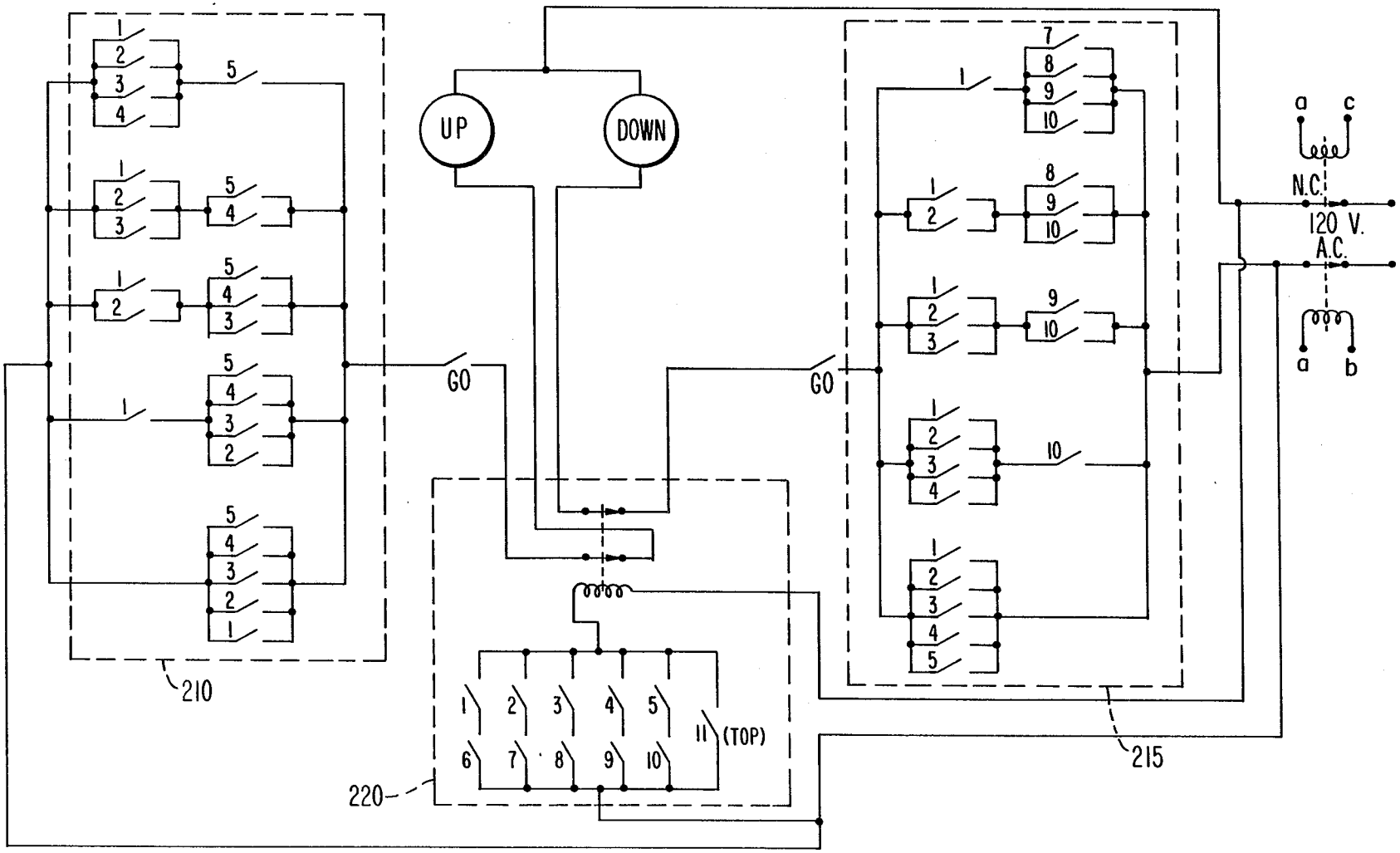
FIG. 10 is a schematic diagram of an automatic positioning circuit of the present invention.

FIG. 10 is a schematic diagram of an automatic positioning circuit of the present invention. FIG. 10 illustrates a relay implementation of the automatic positioning logic illustrated FIGS. 8A and 8B. In FIG. 10, a relay circuit 210 implements the UP logic shown in FIG. 8A, and a relay circuit 215 implements the DOWN logic illustrated in FIG. 8B. The STOP logic shown in FIGS. 8A and 8B is represented by a schematic relay circuit 220 shown in FIG. 10.

The automatic positioning circuitry illustrated in FIG. 10 interfaces with the manual positioning circuit illustrated in FIG. 9 via the points "a," "b" and "c" shown in each of FIG. 9 and FIG. 10. The UP and DOWN designations in FIG. 10 represent the UP and DOWN solenoid valves 90 (FIG. 7) for a given module. As in FIGS. 8A and 8B, the signal GO in FIG. 10 represents that each of the gates for the storage positions is closed, and therefore, it is safe to move a module.

Figure 11:
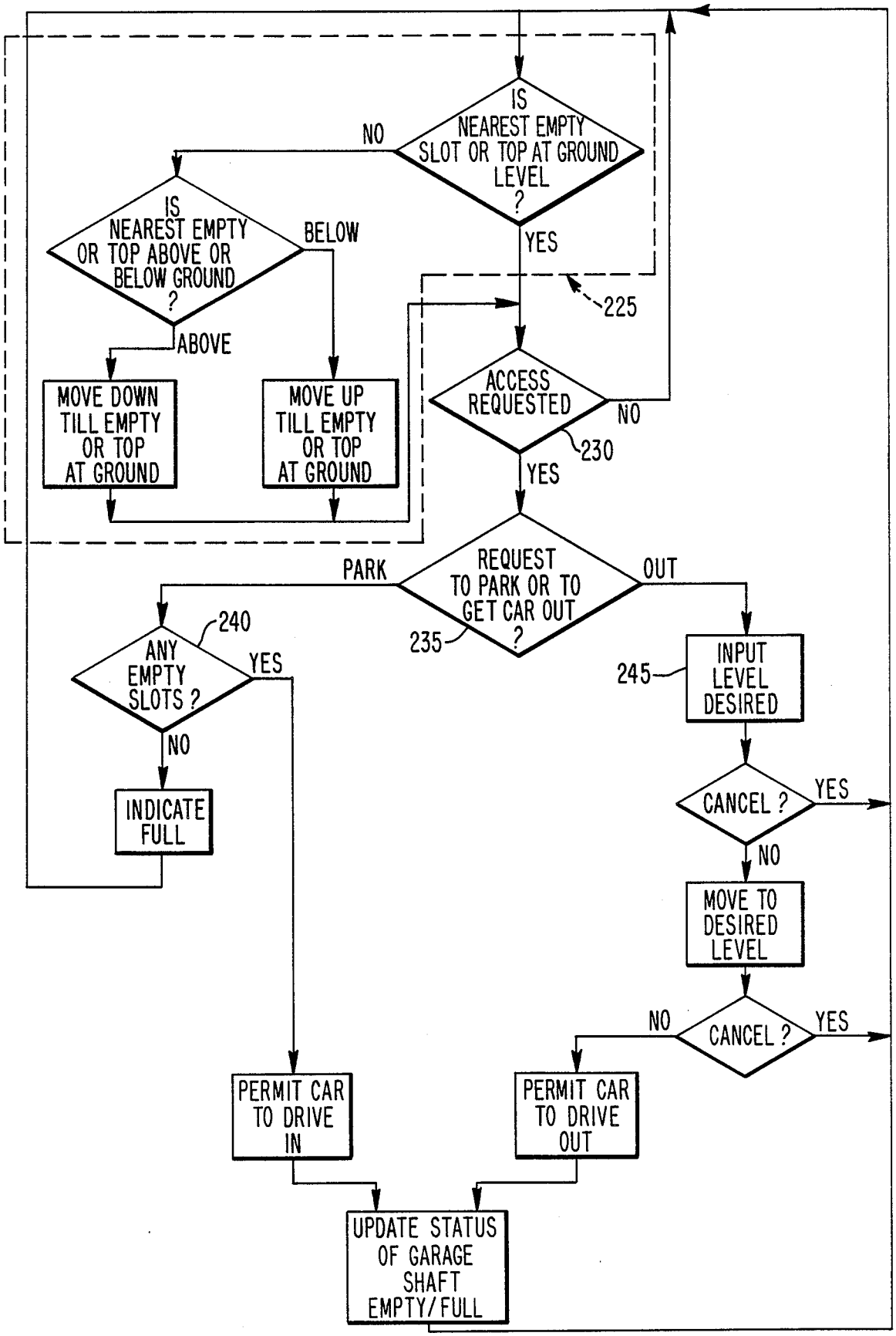
FIG. 11 is a flowchart illustrating the logic flow for a control system of the present invention.

FIG. 11 is a flow diagram illustrating the logic flow for a control system of the present invention. The logic enclosed within the broken line box 225 ensures that either an empty storage position 25 or the top of a module 15 is at the ground access point 35. As a result, a vehicle can immediately access an empty storage position. Furthermore, because either an empty storage position or the top of the module is at the ground access point 35, a driving lane always exists between modules aligned from front to back in the parking system, such as shown in FIG. 2 with storage positions 110, 115 and module top 20.

If a request for access to the system is detected in decision block 230, the next step is to determine whether or not a vehicle wishes to enter or exit from the system. This determination is made in decision block 235. If a vehicle wishes to enter the system, decision block 240 determines whether or not there are any empty storage positions available for the vehicle in the module. If there are no empty storage positons, then via the processing indicated by logic 225, the top of the module is at ground level access point 35. Accordingly, no further vehicles can be admitted to the module. The processing also monitors the open/closed status of the gate for the lane including, for example, storage positions 110 and 115 in FIG. 2, and indicates that the lane is full. Processing then returns to block 225.

If the request is to retreive a vehicle, then processing block 245 determines the storage position desired to be moved to the ground level access point 35. This information can be manually input (e.g., via selector switch 185 shown in FIG. 4), or read from, for example, a magnetic card or other memory device issued to the driver upon entering the system. After determining the desired storage position, the module is moved to the desired storage position if the request has not been cancelled. After the desired storage position reaches the ground level access point, a further check is made in order to determine whether or not the access request has been cancelled. If not, entry to the system is enabled and processing returns to processing block 225.

Those skilled in the art will readily recognize that the logic flow shown in FIG. 11 and described above can be easily adapted to any number of modules by, for example, inputting the module and level number in processing step 245. Additionally, the processing indicated by the box 225 can be executed for each module or any number of modules. The choice depending upon the amount of redundancy desired, system cost and, for example, reliability factors.

Figure 13B:
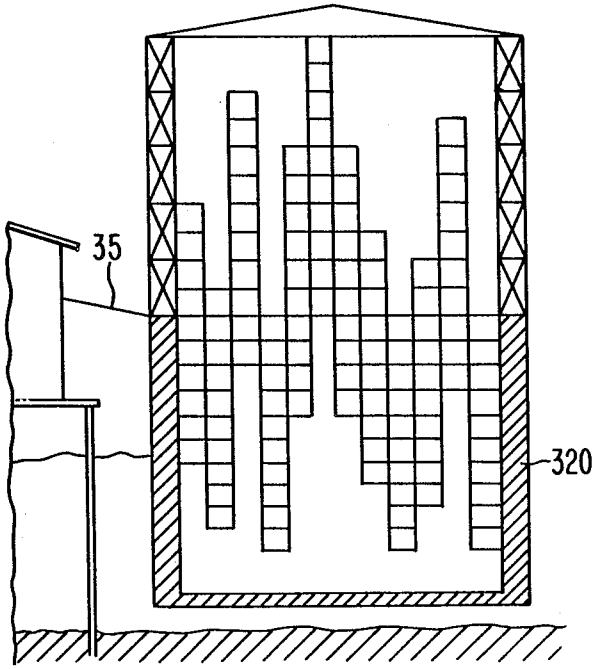
FIGS. 13A and 13B are schematic illustrations of the waterfront embodiment of the present invention.
Figure 13A:
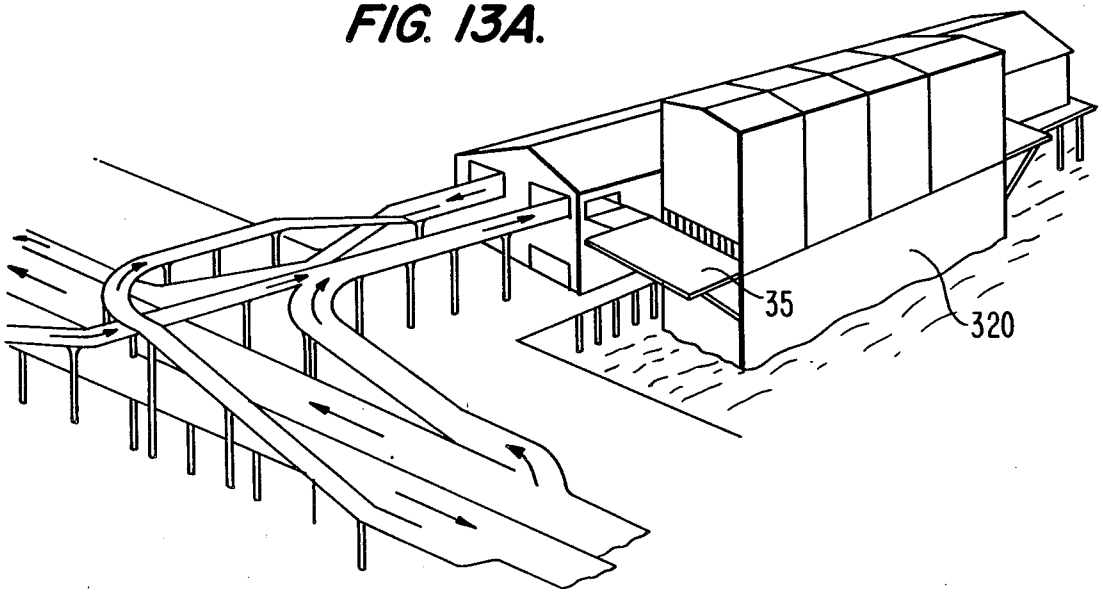

FIGS. 13A and 13B illustrate a waterfront embodiment of the present invention constructed on a concrete barge 320. This embodiment capitalizes on the small area needed by a parking garage system embodying the present invention, and can be located near expressways and rivers in major metropolitan areas such as shown in FIG. 13A. For example, in a parking garage system embodying the present invention 1000 cars can be parked in a space as small as 110′×220′, and depending upon the size of the modules 15, up to 2000 cars can be parked in this space.

As shown in FIGS. 13A and 13B, entry and exit from a parking garage system embodying the present invention is not limited to one end of the garage. Instead, to improve traffic flow, respective ends of the garage can be dedicated to exit and entry. Furthermore, it is not necessary that all of the lanes on a given side be dedicated to either entry or exit. Instead to permit use of the parking garage of the present invention in areas of high traffic congestion, the lanes can be arranged so that, for example, half are dedicated to permit entry at one end and the other half permits exit at the same end.

The present invention provides quick access to storage positions, small space requirement parking and driver parking without the need for an operator to park cars.

Those skilled in the art will recognize modifications and equivalents of the present invention. The scope of the present invention is therefore limited only by the appended claims and equivalents thereof.

What is claimed is:

1. A parking garage system comprising:

a housing having a ground level access point and having a plurality of shafts positioned therein;

a plurality of modules respectively positioned in the shafts, the modules having a plurality of storage positions and a top, each storage position having any empty or a filled status; roller means respectively positioned between the housing and each of the modules for enabling the modules to slidably move within each of the shafts;

first detecting means, operatively connected to each of the storage positions in each of the modules, for detecting the status of the storage positions and for providing an empty signal when a storage position having an empty status is detected;

second detecting means, operatively connected to each module, for detecting when a storage position of the module is at the ground level access point and for providing a level signal in response to the storage position being at the ground level access point;

means for defining a module and a storage position within the defined module to be moved to the ground level access point and providing a defining signal in accordance with the definition;

moving means for automatically moving each of the modules such that a storage position having an empty status or the top of a module is at the ground level access point in accordance with the empty signal and the level signal, and for automatically moving the defined module so that the defined storage position is at the ground level access point in accordance with the defining signal; and hydraulic power means, responsive to the means for automatically moving each of the modules, for moving the modules within the shafts, said hydraulic power means including sump means for holding, receiving, and storing hydraulic fluid;

a plurality of hydraulic pistons;

a plurality of down valves, respectively connected to corresponding ones of said pistons so as to permit hydraulic fluid to flow from said corresponding ones of said pistons;

a plurality of up valves, respectively connected to corresponding ones of said pistons so as to permit hydraulic fluid to flow to said corresponding ones of said pistons;

pump means for providing hydraulic fluid to said up valves;

acumulator means, receiving hydraulic fluid, and for holding and providing hydraulic fluid at a minimum of a pre-determined pressure;

valve means for selectively providing hydraulic fluid from: (1) said sump means to said pump means, (2) said acumulator means to said pump means, (3) at least one of said down valves to at least one of said up valves while the piston associated with said at least of one said down valves is moving down, (4) at least one of said down valves to said pump means while the piston associated with said at least of one said down valves is moving down, (5) said acumulator means to at least one of said up valves, (6) said sump means to said acumulator means, and (7) at least one of said down valves to said acumulator means while the piston associated with said at least one of said down valves is moving down.

2. A parking garage system comprising:

a housing having a ground level access point and having shafts positioned therein;

a plurality of modules, each positioned within a corresponding one of said shafts, each of said modules having a plurality of vertically oriented storage positions, each position having an empty or filled status;

roller means positioned between the housing and the storage means, for enabling the storage means to slidably move within the shafts;

power means for moving the storage means within the shafts in response to a control signal, and hydraulic power means including sump means for holding, receiving, and storing hydraulic fluid;

a plurality of hydraulic pistons;

a plurality of down valves, respectively connected to corresponding ones of said pistons so as to permit hydraulic fluid to flow from said corresponding ones of said pistons;

a plurality of up valves, respectively connected to corresponding ones of said pistons so as to permit hydraulic fluid to flow to said corresponding ones of said pistons;

pump means for providing hydraulic fluid to said up valves;

acumulator means, receiving hydraulic fluid, and for holding and providing hydraulic fluid at a minimum of a pre-determined pressure;

valve means for selectively providing hydraulic fluid from: (1) said sump means to said pump means, (2) said acumulator means to said pump means, (3) at least one of said down valves to at least one of said up valves while the piston associated with said at least of one said down valves is moving down, (4) at least one of said down valves to said pump means while the piston associated with said at least of one said down valves is moving down, (5) said acumulator means to at least one of said up valves, (6) said sump means to said acumulator means, and (7) at least one of said down valves to said acumulator means while the piston associated with said at least one of said down valves is moving down.

3. A parking garage system according to claim 2, wherein the module has a top and the control means comprises:

means for automatically moving a module up so that a storage position having an empty status is at the ground level access point;

means for automatically moving the module down so that a storage position having an empty status is at the ground level access point; and stop means for automatically stopping movement of the module in response to a storage position having an empty status being at the ground level access point.

4. A parking garage system according to claim 3, wherein the control means further comprises:

means for specifying a storage position of the module; and position means for moving the specified storage position of the module to the ground level access point.

5. A parking garage system according to claim 4, wherein the control means further comprises:

first detect means for detecting the status of a storage position and for providing an empty signal in response to detecting a storage position having an empty status; and second detect means for detecting when a storage position of the module is at the ground level access point and for providing a level signal in response to the storage position being at the ground level access point.

* * * * *